US005325849A

United States Patent [19]

Rugo

[11] Patent Number: 5,325,849

[45] Date of Patent: Jul. 5, 1994

[54] CONTINUOUS PASSIVE MOTION DEVICE

[76] Inventor: Eric P. Rugo, P.O. Box 3233, Sea Bright, N.J. 07760

[21] Appl. No.: 891,726

[22] Filed: Jun. 1, 1992

[51] Int. Cl.[5] ..... A61H 1/02

[52] U.S. Cl. ..... 601/34

[58] Field of Search ..... 128/25 R, 25 B, 25 C; 482/145, 904, 907; 602/27, 40

[56] References Cited

U.S. PATENT DOCUMENTS 4,432,543 2/1984 Normandin ..... 128/25 R
4,756,523 7/1988 Rasmussen ..... 482/73
4,825,852 5/1989 Genovese et al. ..... 128/25 C
4,974,830 12/1990 Genovese et al. ..... 128/25 C

FOREIGN PATENT DOCUMENTS 3037619 5/1982 Fed. Rep. of Germany .... 128/25 R

*Primary Examiner*—Richard J. Apley
*Assistant Examiner*—Jeanne M. Mollo
*Attorney, Agent, or Firm*—Porter, Wright, Morris & Arthur

[57] ABSTRACT

An improved continuous passive motion machine preferably having an ankle lock assembly, an extension lock assembly, and an extended rod or handle to assist in locking/unlocking.

3 Claims, 9 Drawing Sheets

Fig. 2
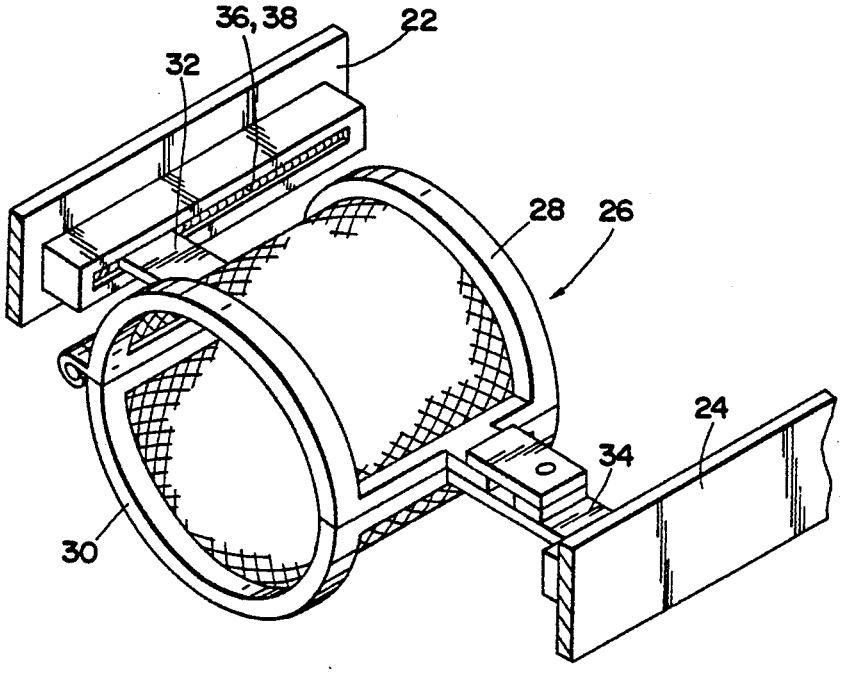
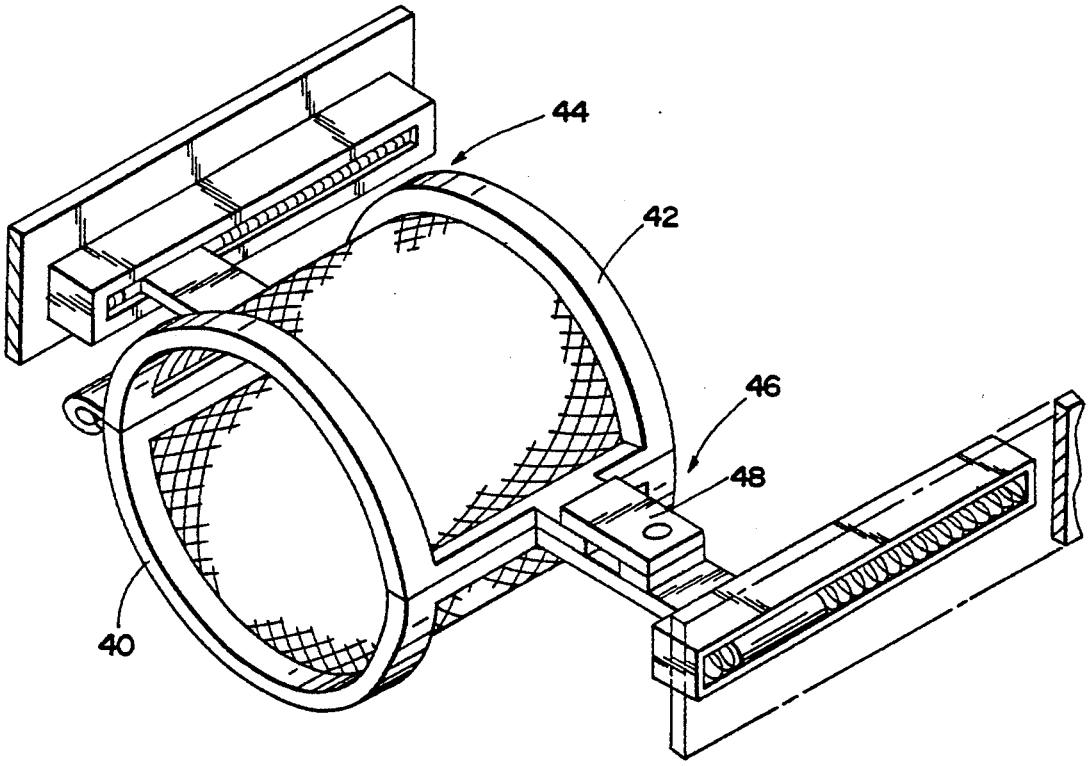
Fig. 3

Fig. 5
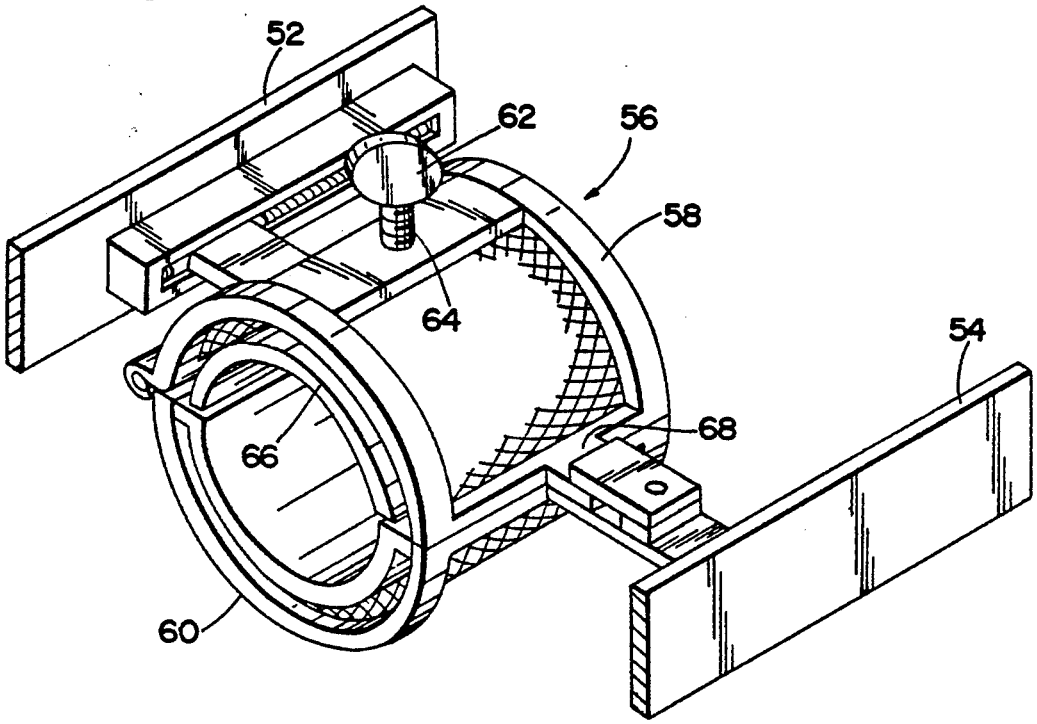
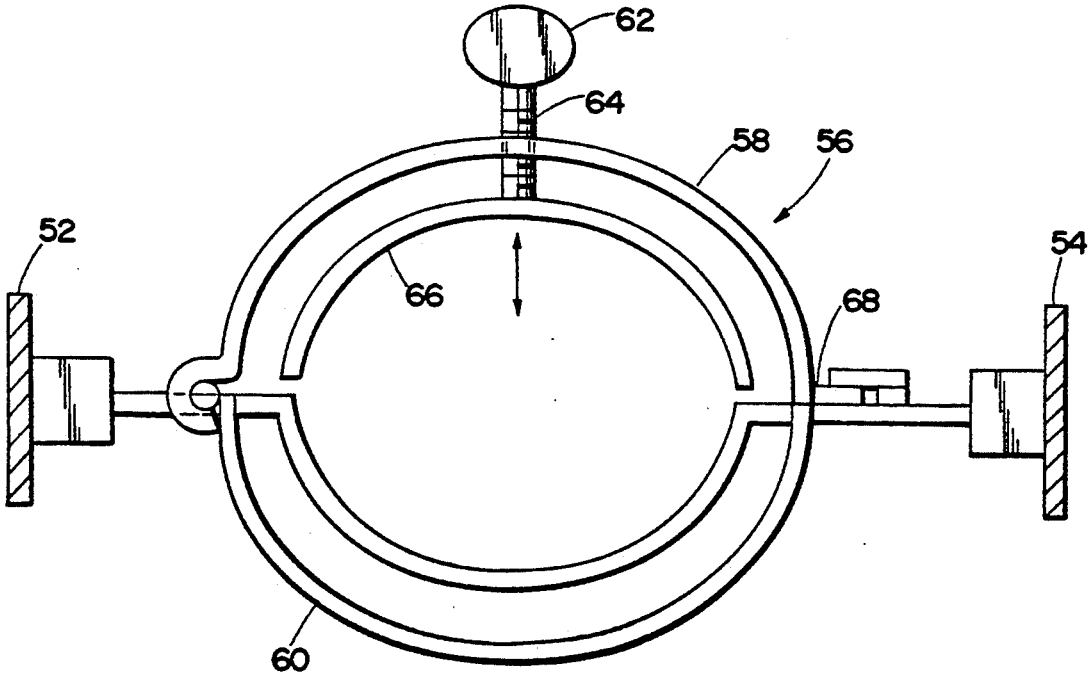
Fig. 6

Fig. 7A
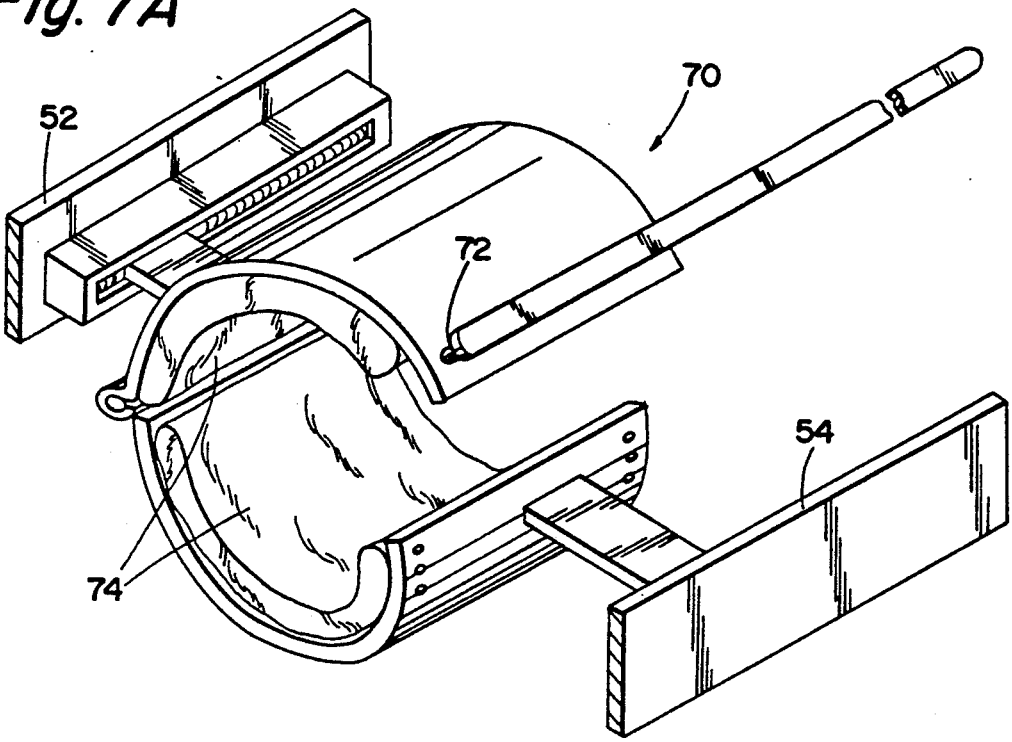
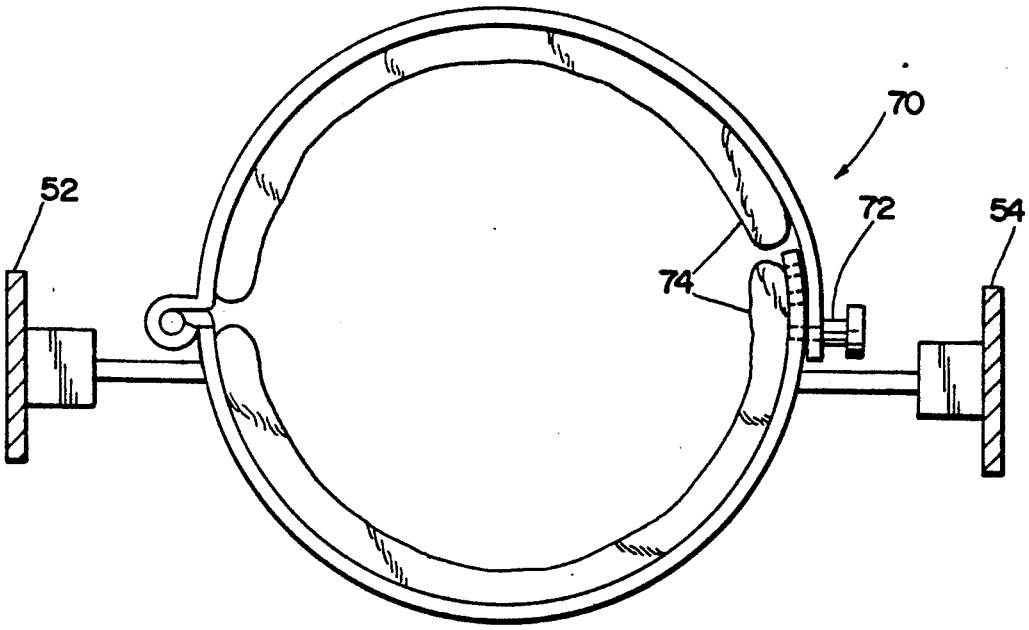
Fig. 7B

Fig. 8A
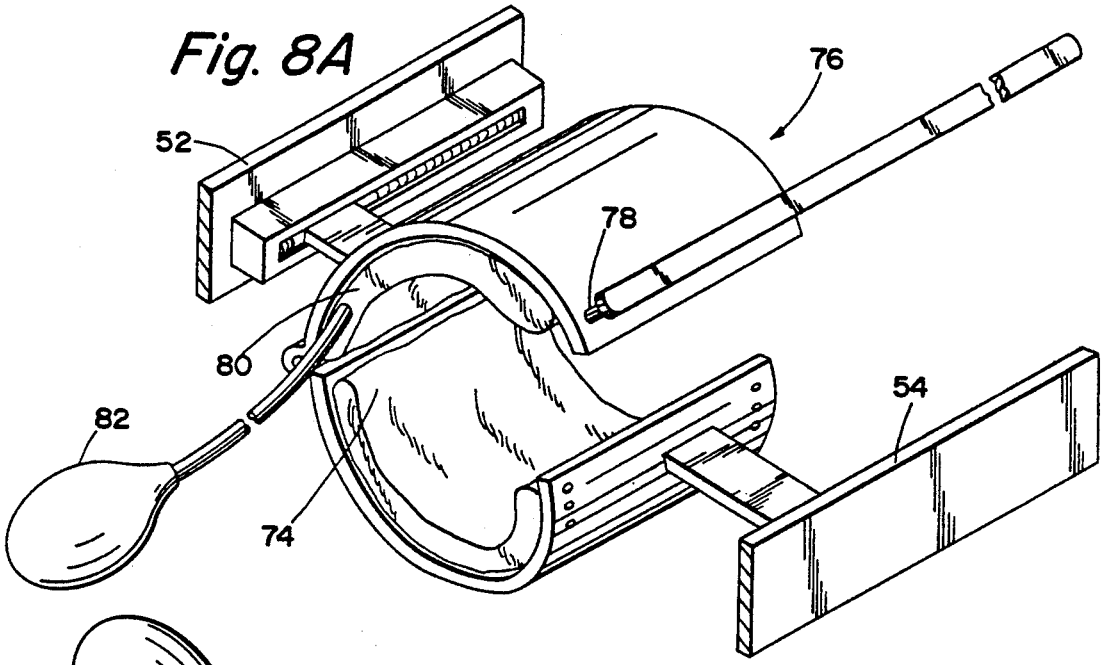
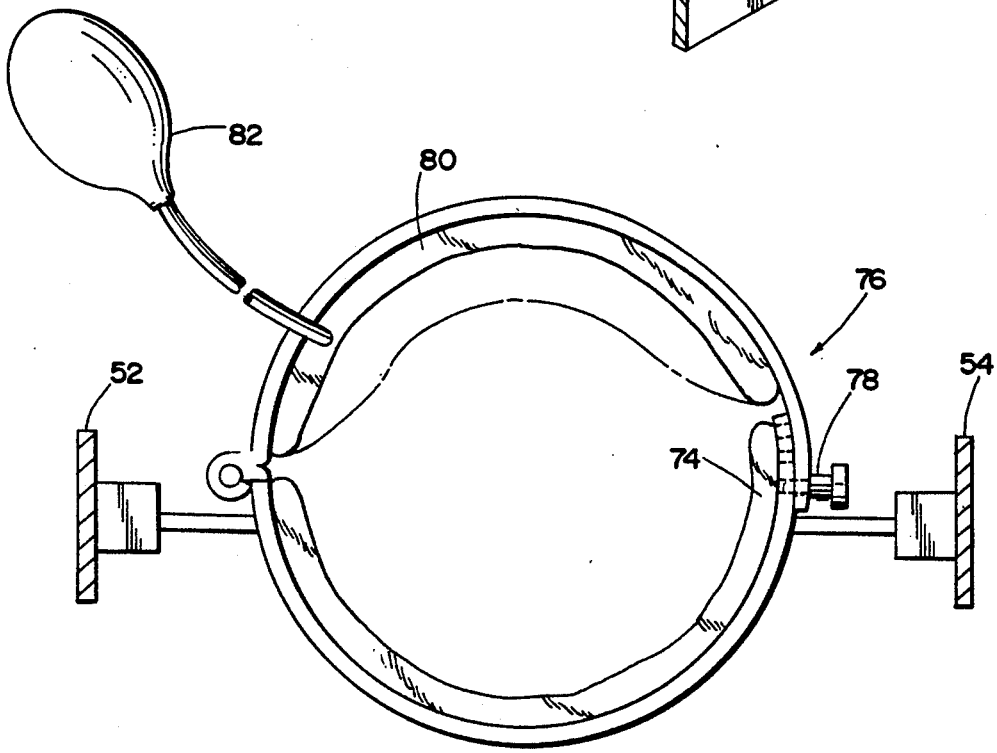
Fig. 8B

CONTINUOUS PASSIVE MOTION DEVICE

BACKGROUND AND SUMMARY OF THE INVENTION

The present invention relates generally to continuous passive motion devices used in the rehabilitation of body limbs that have been disabled in some way. More particularly, the present invention provides improvements to a knee continuous passive motion (CPM) machine. Existing CPM devices have been used for sometime to assist doctors and patients in recovering all or part of the use of a body member such as a hand, wrist, knee, ankle, etc. that has been disabled in someway. Patients hurt in accidents or patients having limbs affected by disease have benefitted greatly from the mechanical assistance provided by a CPM device to assist the patient in reacquiring use of a damaged limb.

Existing CPM machines have been found by the present inventor to have at least three deficiencies which are addressed by the present invention. First, in existing machines there is no adequate way of securing the lower limb (below the knee) to maintain alignment of the lower limb throughout a machine cycle. This may be due to the second problem which is that there is no convenient means afforded the patient for locking (entering) and unlocking (exiting) the lower limb from existing machines. Third, the existing devices do not offer controlled resistance with respect to limb extension.

With respect to the first problem of locking the limb in place, the present inventor has discovered that a patient's limb must be secured adequately in the machine or otherwise the full benefits of the CPM device will not be realized. By more rigidly securing the limb in place in the machine it reduces the upward motion of the lower limb while the machine moves the limb into flexion.

With respect to affording the patient a convenient means for entering and exiting the machine, most patients find it difficult and uncomfortable to bend forward to a position where they could actuate any mechanism of the machine at or near their ankle position. Some patients may find it impossible due to obesity, pain, or overall weakness to reach this far.

The last of the three above mentioned problems is the lack of means for generating controlled resistance for patients having extension contractures. Existing CPM devices do not provide calibrated, reproducible, and controlled means for generating resistance and extension. Extension and flexion are not treated similarly by the CPM device. When flexion is set it is limited to within a patient's tolerance. The same should be considered with respect to extension. The machine should be designed to insure that extension is indeed taking place. Existing CPM devices provide extension motion but do not ensure that extension is actually being experienced by the patient.

The present invention provides answers to the above referenced problems. In the present invention the lower extremity is secured into place in the machine. The location of the securing structure of the present invention is preferably between the tibial length adjustment knob and the foot cradle on existing knee CPM machines. In the present invention an ankle lock is built into the frame of the carriage. Motion is restricted to the longitudinal axis of the frame. Within this range of motion, compensating for any forward and backward movement of the leg during a motion cycle, compression and expansion of controlled springs will tend to restore the distal member to a center position. A lock, latch or hinge of various types may be provided to allow opening and closing of the ankle lock for entering and exiting from the ankle cradle. When the lock is closed the lower extremity is completely surrounded and made immobile for motions perpendicular to the frame's longitudinal axis. This arrangement keeps the motion of the distal extremity parallel to the frame's longitudinal axis throughout a flexion and extension cycle. This accomplishes a calibrated and reproducible range of motion. Angular measurements made on the machine members therefore accurately represent the flexions experienced between the distal and proximal members of the patient. Having a calibrated and reproducible range of motion allows doctors' recommendations, regarding flexion settings and patients' tolerance, to be strictly followed.

Also in the present invention handle means attached to the machine may be provided for securing and releasing the distal member from the ankle lock. Therefore, even a patient in a prone position can operate the ankle lock device. A long handle may be specially equipped so that a rotary motion of the handle will be translated into locking or unlocking of the mechanism.

To solve the third problem, the present invention may be equipped with an extension piece. Clamping the proximal member affords a means for controlling the extension resistance to be generated. Similar to the ankle lock, the extension piece is preferably secured to the frame in an area above the normal knee position. Adjustment of the extension piece position along the frame may be provided to accommodate different proximal member lengths. An adjustable clamping arrangement is one preferred extension piece for fastening the proximal member to the machine. In one embodiment of the present invention a one time set-up adjustment of the extension piece may be made to fit a particular patient enabling quick release and locking to be accomplished during subsequent use. This added capability gives the clinician an accurate way to gauge and control the amount of resistance being applied to extension thus providing a reproducible method of treating extension contractures with the CPM device.

Further features of the present invention may include the placement of cushioned material or padding on all areas of the device that bear against the patient's skin and inflatable bladders which may form part of the inner portion of the ankle lock and/or extension piece to softly but firmly secure a limb in place. With the above listed improvements of the present invention there will be increased accuracy in the measurement and setting of the range of motion of the device relative to the actual range of motion experienced by the patient. The present invention further provides easier entering and exiting and will offer slight, constant, and controlled resistance to the upper leg which improves the device's capability of controlling resistance in extension.

The foregoing and other objects and advantages of the present invention will become more apparent when viewed in light of the accompanying drawings and following detailed description.

BRIEF DESCRIPTION OF THE DRAWINGS

FIG. 2 is a perspective view of an ankle lock of the present invention installed on the frame of a CPM device;

FIG. 3 is an enlarged view of the ankle lock of FIG. 2;

FIG. 5 is a perspective view of an extension lock of the present invention installed on the frame of a CPM device;

FIG. 6 is an elevational view of the extension lock of FIG. 5;

FIG. 7A is a perspective view of another embodiment of the ankle lock of the present invention having adjustable sizing means and shown in its unlocked position;

FIG. 7B is the ankle lock of FIG. 7A shown in its locked position;

FIG. 8A is a perspective view of another embodiment of the extension support of the present invention having adjustable sizing means and an air bladder, shown in its unlocked position;

FIG. 8B is the extension support member of FIG. 8A shown in its locked position;

DESCRIPTION OF PREFERRED EMBODIMENT(S)

Figure 1:
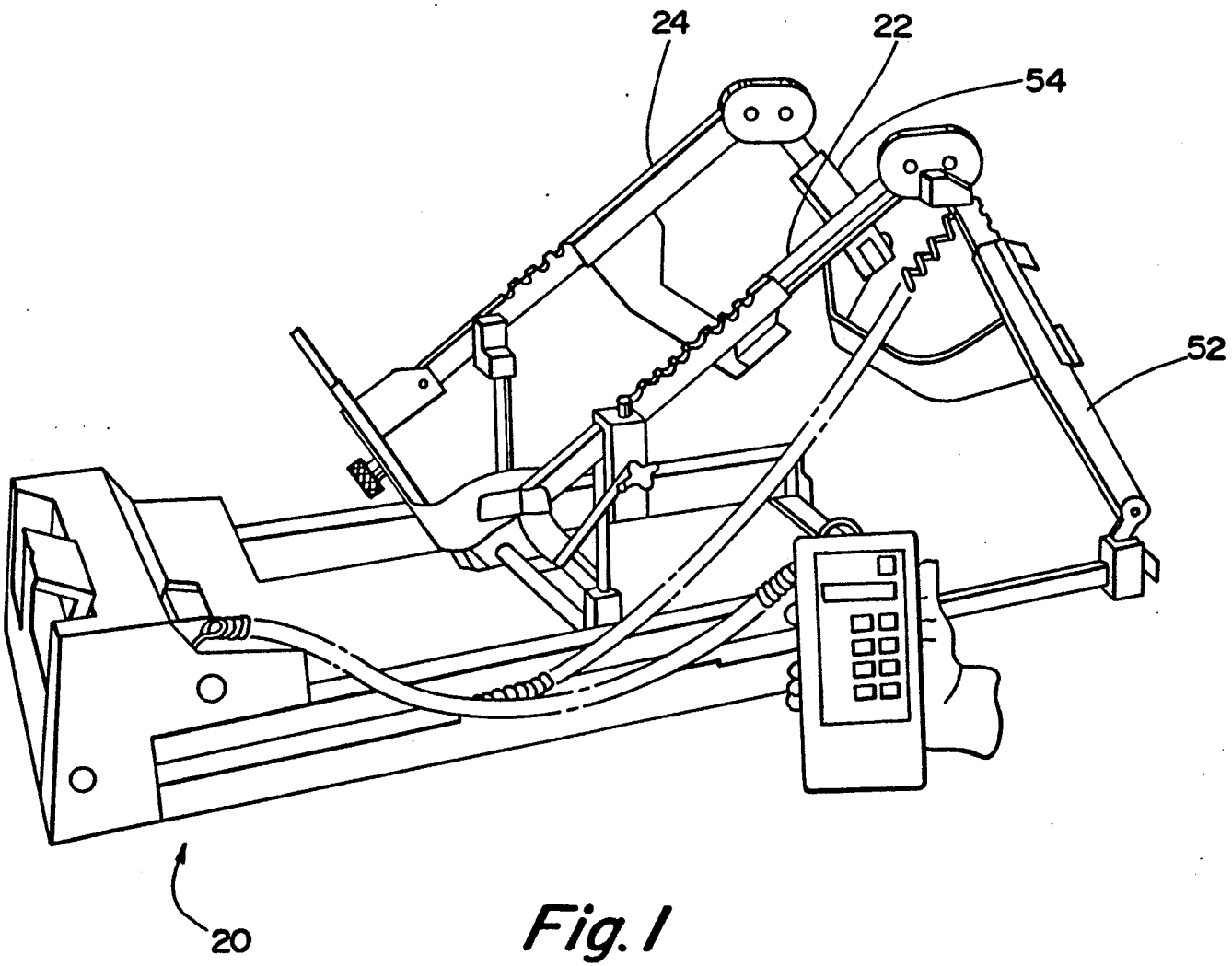
Fig. 1 (PRIOR ART)
FIG. 1 is a perspective view of a knee CPM machine on which the improvements of the present invention may be incorporated.

Referring now to the drawings, and particularly FIG. 1, there is shown a typical CPM device 20 on which the improvements of the present invention may be employed. In FIG. 1 there is illustrated a CPM device 20 having two relatively parallel and generally rigid longitudinal support members 22, 24 which form part of a frame. An ankle lock assembly 26 may be secured to the longitudinal support members as shown in FIG. 2. The patient's ankle is inserted between the annular shaped ankle enclosing members 28, 30. The ankle lock assembly 26 may be equipped with two runners 32, 34 each of which may slide within spring loaded slots 36, 38 formed within the longitudinal support members as shown in FIG. 3. As movement of the lower limb occurs the ankle will force the ankle lock assembly along the path of the slots.

Figure 4:
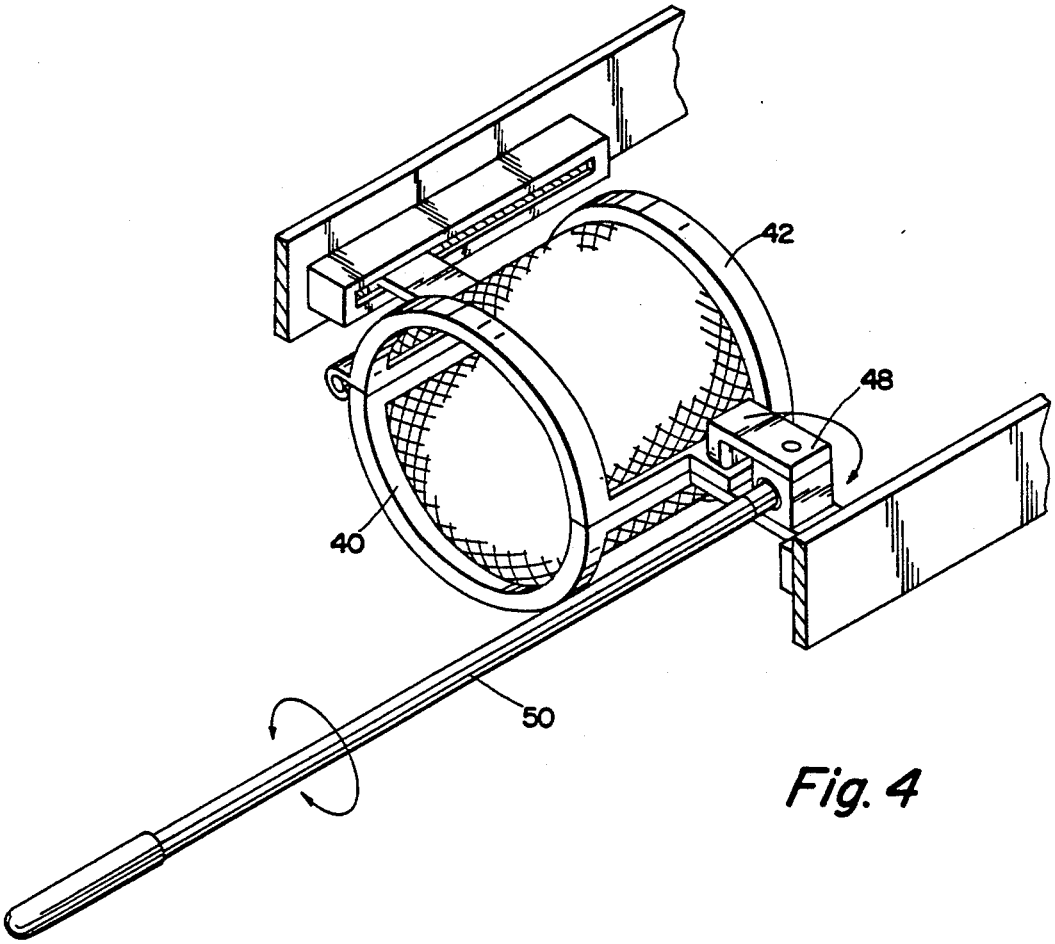
FIG. 4 is a perspective view of the ankle lock of FIG. 2 being engaged by a locking/unlocking handle of the present invention.

The generally annular shaped ankle enclosure members in this embodiment may be two "C" shaped halves 40, 42 hinged at one end 44 and capable of being latched or locked in place at a second end 46 as shown in FIG. 3. A locking/unlocking pin 48 may be incorporated to unite the two halves of each annular member around the user's ankle and hold them in place during use of the device. The pin can then be unlocked to allow the annular member halves to open and release the patient's ankle. A long handle 50 may be provided as shown in FIG. 4 with means at one end thereof to engage the locking/unlocking pin. By turning the handle clockwise or counter-clockwise the pin is thereby locked and unlocked respectively. It should be recognized that the direction to turn the handle and the pin relationship, both with respect to the handle and the annular members, may vary in their design to include a number of well known locking/unlocking, latching/unlatching mechanisms that would be suitable for the present invention.

In FIGS. 5 and 6 the upper or proximal part of the CPM device is shown, again having two relatively parallel and generally rigid longitudinal support members 52, 54 which reside on either side of a patient's leg just above the knee. One embodiment of an extension lock assembly 56 is shown secured to and lying between each longitudinal member. The extension lock comprises two halves 58, 60 which when united form a generally annular shaped member that surrounds the patient's thigh just above the knee. An adjustment knob 62 is provided in association with the half of the member 58 that overlies the top or front portion of the patient's thigh. By turning the knob in a clockwise direction a threaded spindle 64 engaged within a threaded hole in the top member half causes an underlying patient contact member 66 to be depressed onto the patient's leg. Once this clamping arrangement is adjusted to the size of the patient's leg a quick release mechanism 68 allows this adjustment to remain at the same setting for future use yet enables quick release of the patient's leg from the device. The quick release mechanism may be a well known latch such as found on windows, hinged lids to boxes, and the like. The extension lock may also simply be a top half piece that lays over the patient's thigh as the thigh rests in a support cradle. This piece would preferrably be hinged to one side of the thigh support cradle and a latch mechanism provided at the other side.

Referring now to FIGS. 7A and 7B, another embodiment of the present invention is shown wherein the ankle lock assembly 70 is provided with a series of holes and a matching facility 72 with pins that insert into these hole positions to provide a variable circumference for fitting various ankle sizes. In addition each ankle support may be provided with a suitable measure of cushioning 74 preferably having both a built in element and a disposable portion that is in contact with the patient when in the machine. The ankle lock is shown in its closed position in FIG. 7B. The built in element is preferably a padding material known as SPANKO. The disposable portion may be lambs wool fabric.

Referring now to FIGS. 8A and 8B an extension support 76 is also shown having a series of holes and a matching facility 78 with pins that insert into these hole positions to provide a variable circumference. In addition, the extension lock assembly may be provided with an air bladder 80 which is inflated by preferably using a built in hand operated air pump 82. The air bladder may be inflated to adjust the level of firmness desired in the upper support. The bladder may be pumped up and released by the patient each time the patient enters and exits the machine. The air bladder may also serve as the built in cushioning for patient comfort for the top section of the extension support device. When the air bladder is inflated appropriately it allows the upper support to passively generate controlled resistance in extension since it naturally fills in the void between the support and the top of the leg. Another feature of this bladder is that it can serve as an emergency pressure release device for those rare occasions when a patient may experience some undue discomfort, by activating an air release valve common to such air pumps.

The bladder may be constructed in a manner similar to that of a blood pressure cuff which has the air bladder protected with an outer cover. The air bladder preferably does not encircle the leg of the patient, however, since this configuration would tend to restrict the blood flow in the patient's leg.

When the patient wishes to enter the machine, the hinged fixture halves (ankle lock and extension support) may be swung over the limb and are latched by a clamp which is rotated into position. The clamp is preferably in the shape of a "c" and engages a strut in the mating part of the fixture. At the extension fixture, this clamp can be rotated directly by the patient. The clamp is accessible for the patient even in the prone position since it resides above the knee. Since the ankle lock may be more difficult to reach, the handle or extension rod may be provided and is preferably removably along the longitudinal support member of the extension frame of the machine and equipped with a small-end handle.

Preferably the design of the fixture is symmetrical allowing the patient to enter and exit the machine from either side. This feature enables the CPM device of the present invention to accommodate either the right or left leg.

To enter the CPM machine, the patient opens both hinged top-half components of the two fixtures. The ankle lock hinge may be moved into place by means of the extension rod or handle connected to the clamp device. After placing their leg into the machine, the patient will flip over the hinged top fixture components and rotate the "c" clamp halves to engage the bottom section halves securely. The patient may then pump up the air bladder to achieve the desired firm support of the extension fixture. To exit the machine the patient releases the pressure of the bladder in the support fixture and releases the latches on both supports.

The present invention is not only useful on newly designed CPM devices but also may be used to retrofit existing CPM machines. A kit may be provided for equipping existing machines with this capability to avoid their obsolescence.

Figure 9:
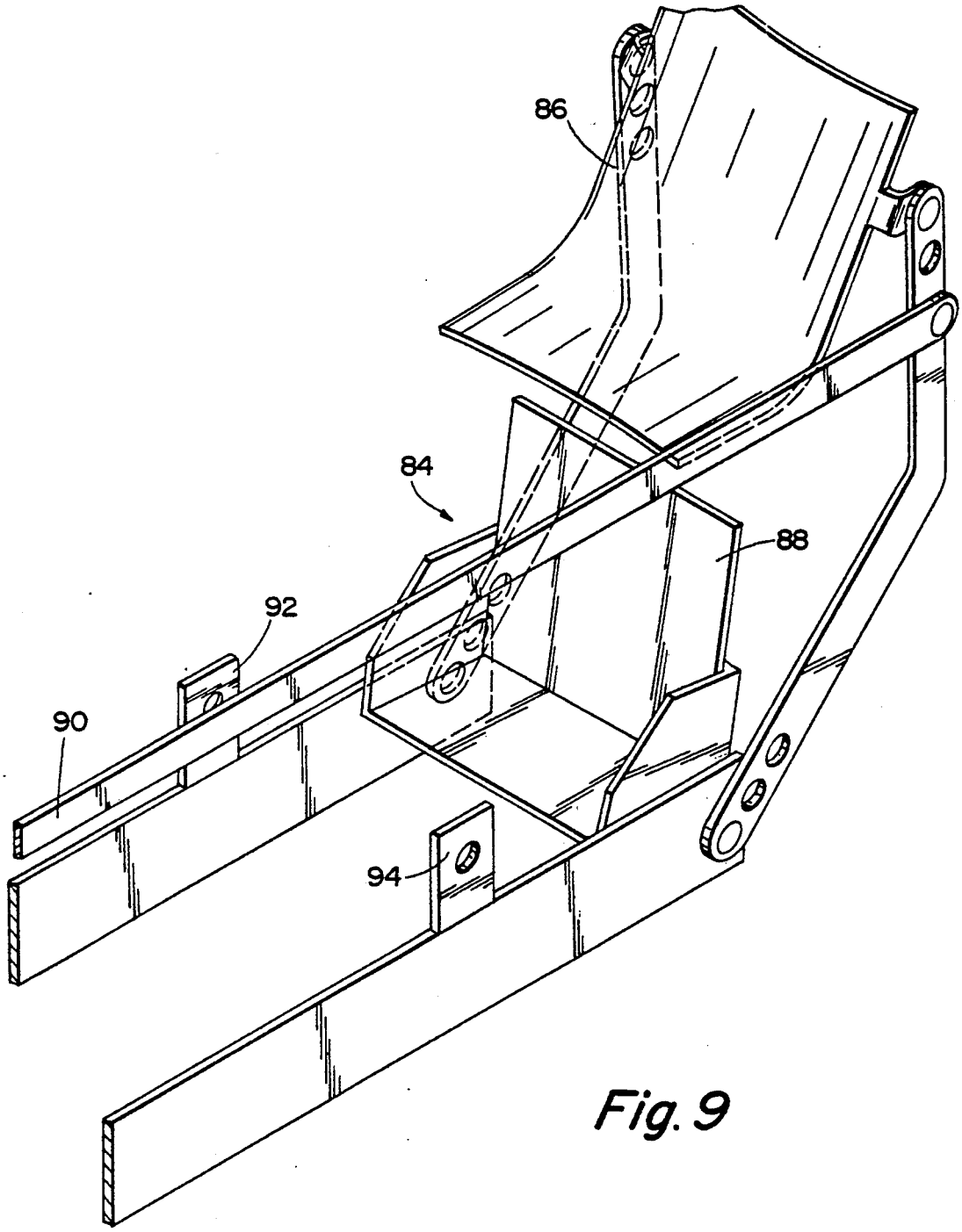
FIG. 9 is a perspective view of another embodiment of the ankle lock of the present invention shown in its swing open position.

FIG. 9 shows another embodiment of the present invention whereby an ankle hold assembly 84 having a bridge 86 is hinged to the frame of the CPM device near the foot cradle 88. An extension rod 90 may be rotatably secured to the ankle hold assembly so that it may pivot, thereby enabling the patient lying in a prone position to pull the assembly down to a position where the bridge is over the ankle and when finished push it up to allow the ankle to be removed from the machine. Two members 92, 94, one on each side, may be secured (e.g.—welded) to the machine frame and be adapted to engage the ankle hold assembly when it is rotated and lowered into place. This embodiment may be adjustable to accomodate different size patients. The locking could be a pin inserted through mating holes of the members and the assembly frame.

Figure 11:
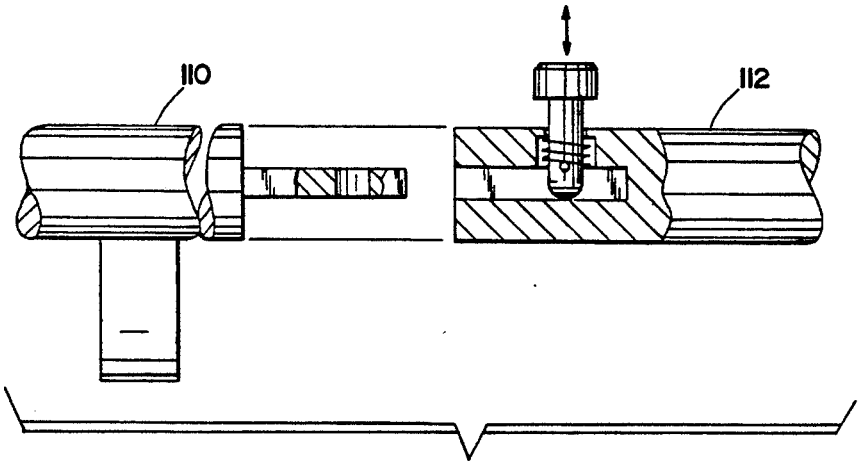
FIG. 11 is a detail side view of the handle means of FIG. 10 as it is about to engage a hook shaft of the ankle lock.
Figure 10A:
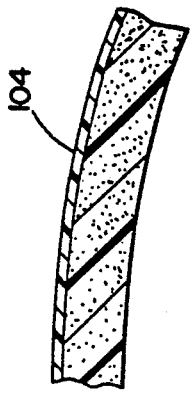
FIG. 10A is a fragmentary section view taken along line 10A—10A of FIG. 10.
Figure 10:
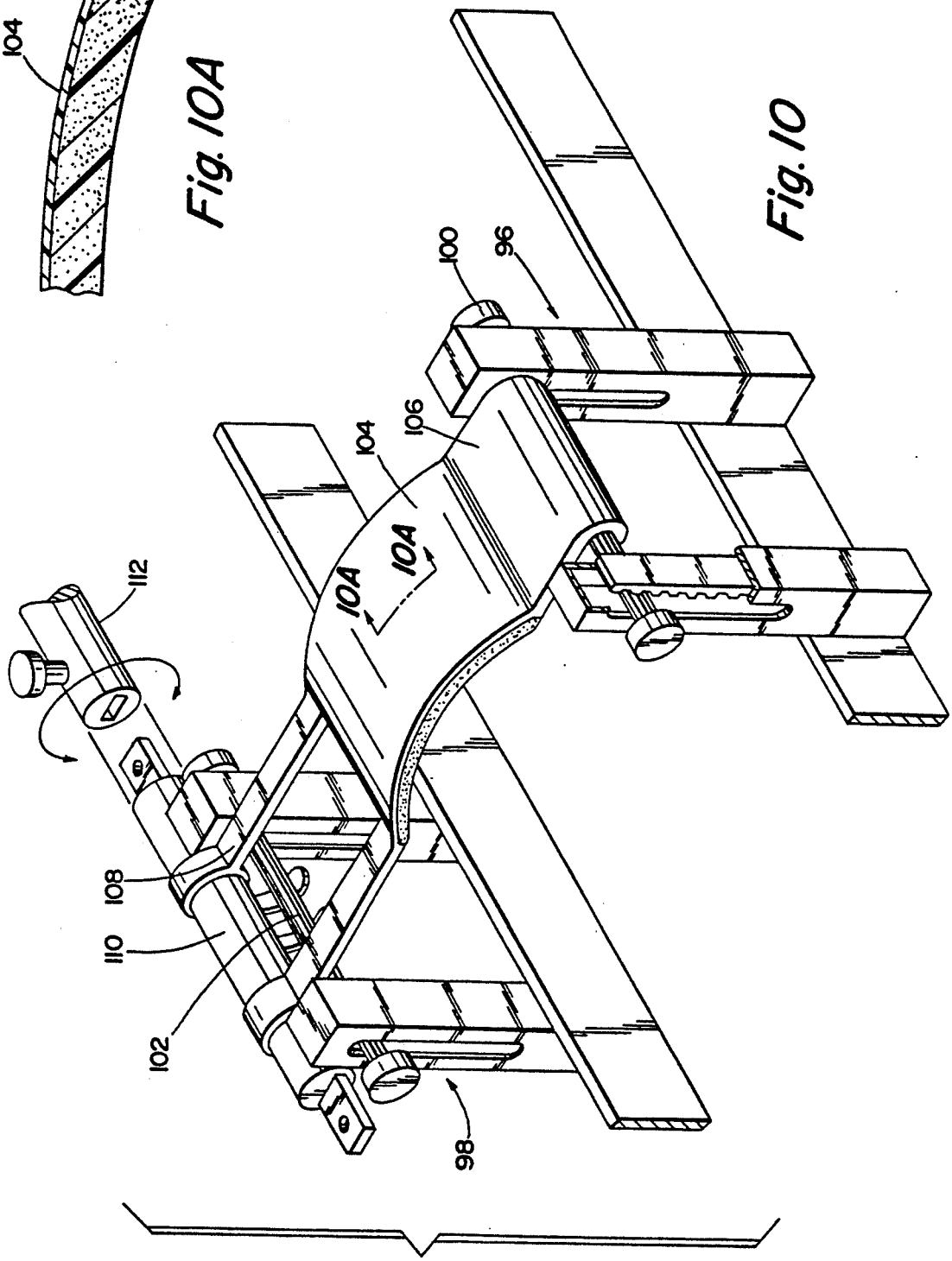
FIG. 10 is a perspective view of a handle means of the present invention in association with another embodiment of an adjustable ankle lock fixture of the present invention.

FIGS. 10 and 11 illustrate yet another embodiment of the present invention whereby the ankle locks are adjustable through particular settings of a set of clamp mountings 96, 98 having cross bars 100, 102 adapted for engaging a clamp 104. One end 106 of the clamp 104 is preferably rotatably secured to one cross bar 100 while the other end 108 of the clamp 104 is preferably equipped with a hook shaft 110 to be engaged with the other cross bar 102. A patient may use the extended handle 112 of the present invention to engage the hook shaft 110 (as shown in FIG. 11) and place it in position with the cross bar 102. Once locked in position the clamp overlies the patients ankle while the patient's ankle may be supported underneath by a calf-support member that spans the frame.

Figure 12:
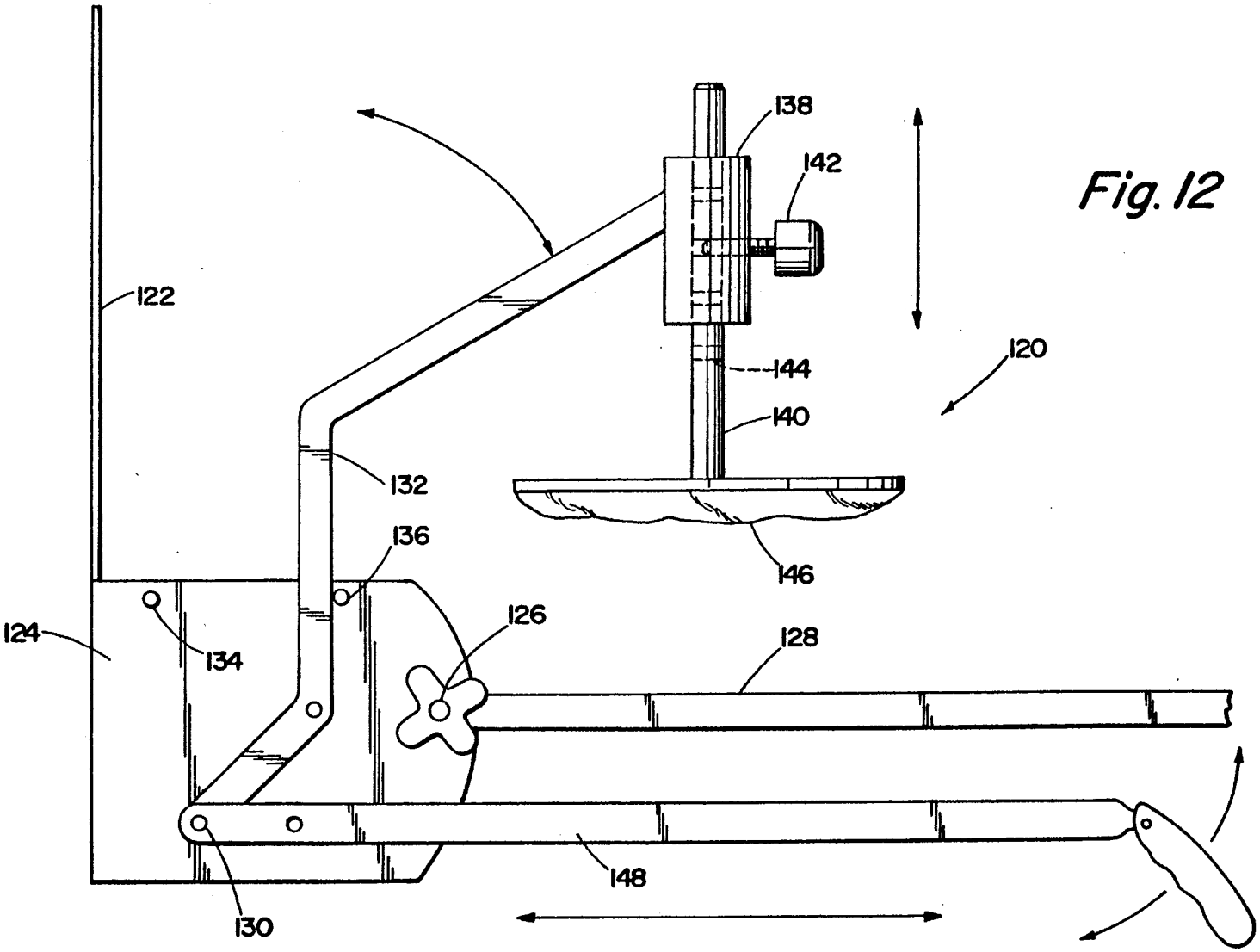
FIG. 12 is a side view of an ankle restraint apparatus of the present invention.

FIG. 12 illustrates another embodiment of the present invention in which an ankle restraint apparatus 120 may replace the ankle lock described above. In this embodiment a foot plate 122 is shown equipped with a side plate 124. The foot plate 122 may be angularly adjusted at knob 126 which may be associated with the longitudinal member 128 of the machine. The ankle restraint 120 may be attached to the plate 124 for rotation about a predetermined axis which may start at junction 130. A support member 132 of the restraint 120 may move about junction 130 through a range of motion limited by stops 134, 136.

At one end of member 132 is secured a housing 138 having a hollow interior through which is extended a rod 140. The rod 140 may be adjustable by raising or lowering and locking in place by inserting a pin 142 through the housing 138 and into holes 144 in the rod 140. At the lower end of the road 140 is secured a preferably padded structure 146 which is designed to rest on the patient's lower shin or ankle and thereby control movement of the patient's leg in that direction, An extended shaft 148 may also be provided for enabling the patient to actuate the apparatus 120 to thereby restrain the lower leg or release it. A handle may be secured to the shaft 148, It is thought that the new and unique CPM device of the present invention and many of its attendant advantages will be understood from the foregoing description, It will be apparent that various changes may be made in the form and construction of the components thereof without departing from the spirit and scope of the invention or sacrificing all of its material advantages, The form of the invention described herein is merely a preferred or exemplary embodiment thereof,

What is claimed:

1. In a continuous passive motion device for exercising a lower limb, including a frame having two generally parallel and rigid longitudinal support members, a foot support, and means for actuating the machine to cause the longitudinal support members and the foot support to move a patient's leg resting in the machine through extension and flexion, the improvement comprising: an ankle hold assembly rotatably secured to said frame such that said ankle hold assembly may be brought into a position adjacent the anterior portion of the patient's ankle; means for enabling said ankle hold assembly to inhibit upward motion of the patient's ankle perpendicular to said longitudinal support members; and means for enabling a patient in the prone position to cause said ankle hold assembly to rotate to said position adjacent the patient's ankle.

2. The device of claim 1, further comprising: means for latching said ankle hold assembly in said position adjacent the patient's ankle.

3. The device of claim 1, further comprising: means for enabling a patient in the prone position to rotate said ankle hold assembly to a second position away from the patient's ankle.

* * * * *